US008343416B2

(12) United States Patent
Morgenstern

(10) Patent No.: US 8,343,416 B2
(45) Date of Patent: Jan. 1, 2013

(54) METHODS AND DEVICES FOR REGULATING THE FLOW RATE AND FOR SLOWING DOWN NON-FERROMAGNETIC, ELECTRICALLY CONDUCTIVE LIQUIDS AND MELTS

(75) Inventor: Hans-Uwe Morgenstern, Freudenberg (DE)

(73) Assignee: TMT Tapping-Measuring-Technology GmbH, Siegen (DE)

( * ) Notice: Subject to any disclaimer, the term of this patent is extended or adjusted under 35 U.S.C. 154(b) by 0 days.

(21) Appl. No.: 13/022,244

(22) Filed: Feb. 7, 2011

(65) Prior Publication Data

US 2011/0174406 A1 Jul. 21, 2011

Related U.S. Application Data

(63) Continuation of application No. 13/057,378, filed as application No. PCT/EP2009/060216 on Aug. 6, 2009.

(30) Foreign Application Priority Data

Aug. 7, 2008 (DE) ..... 10 2008 036 799
Jul. 29, 2009 (DE) ..... 10 2009 035 241

(51) Int. Cl.
*F15D 1/00* (2006.01)

(52) U.S. Cl. ..... 266/45; 266/237; 222/594

(58) Field of Classification Search ..... 266/237, 266/45; 222/594, 597
See application file for complete search history.

(56) References Cited

U.S. PATENT DOCUMENTS 3,701,357 A 10/1972 Granstrom et al.
3,706,399 A 12/1972 Sundberg
3,767,090 A 10/1973 Sundberg et al.
3,883,045 A 5/1975 Gerbig
4,173,299 A * 11/1979 Kollberg et al. ..... 222/594
5,616,166 A 4/1997 Fujita et al.
5,681,527 A 10/1997 Aoi
2011/0168273 A1* 7/2011 Morgenstern ..... 137/13
2011/0174406 A1* 7/2011 Morgenstern ..... 137/807

FOREIGN PATENT DOCUMENTS

DE 21 10 401 A1 10/1971
DE 2333802 A1 1/1974
GB 1301704 1/1973
WO 00/71761 A1 11/2000

OTHER PUBLICATIONS

PCT Translation of International Preliminary Report on Patentability, Application No. PCT/EP2009/060216, Feb. 17, 2011.

The International Search Report as mailed on Jan. 26, 2010 for International Application No. PCT/EP2009/060216.

Updated version of International Preliminary Report on Patentability mailed May 5, 2011 for corresponding application PCT/EP2009/060216.

* cited by examiner

*Primary Examiner* — Scott Kastler
(74) *Attorney, Agent, or Firm* — Quarles & Brady LLP

(57) ABSTRACT

A regulating device regulates the flow rate of non-ferromagnetic, electrically conducting liquids and melt streams through magnetic fields inducing eddy currents in the melt stream. In a preferred embodiment, the regulating device controls the melt stream using at least one stationary magnetic field with a constant polarity, at least one stationary magnetic alternating field or using a multi-poled magnetic travelling field, in such a way that the magnetic field lines transversally penetrate the melt flow across the entire cross section thereof and such that a voltage is induced in the melt stream by the magnetic fields.

20 Claims, 15 Drawing Sheets

Figure 1:
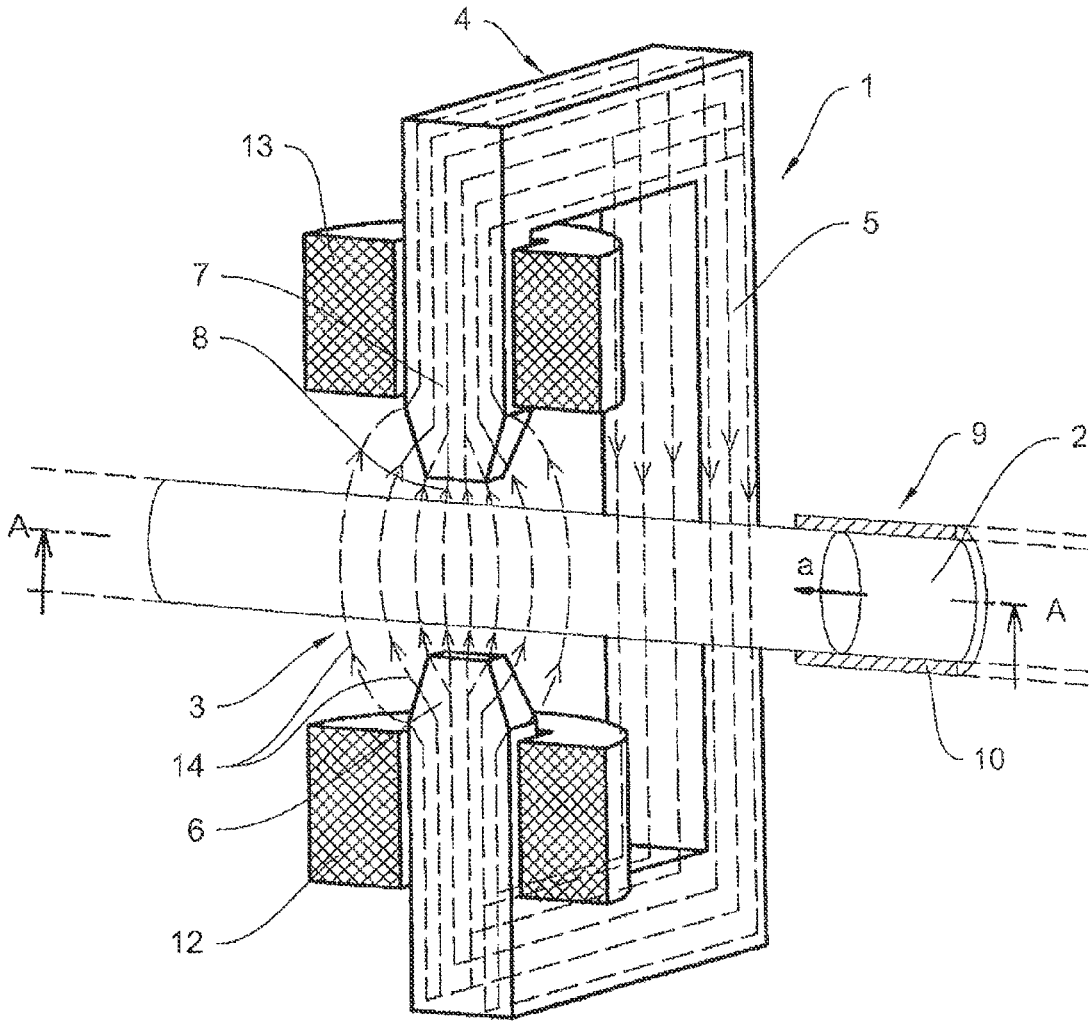

Fig. 2a
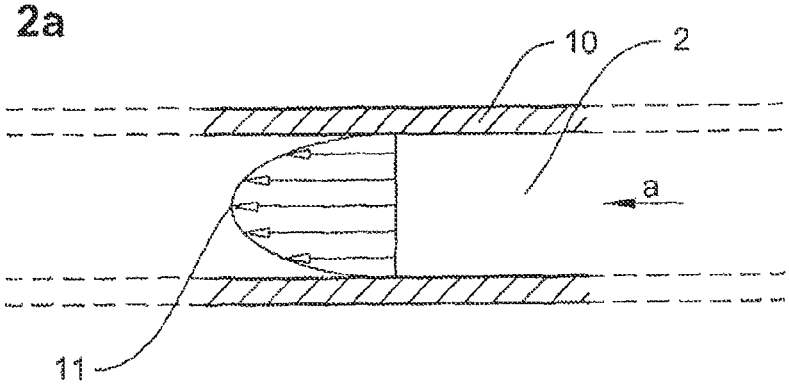
Fig. 2c
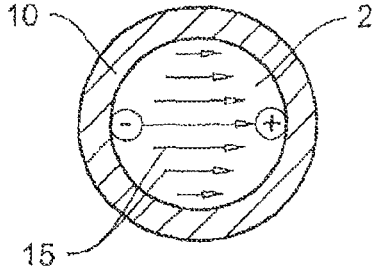
Fig. 2b
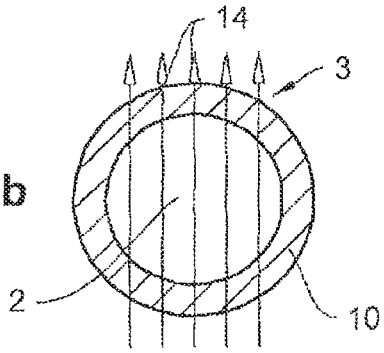
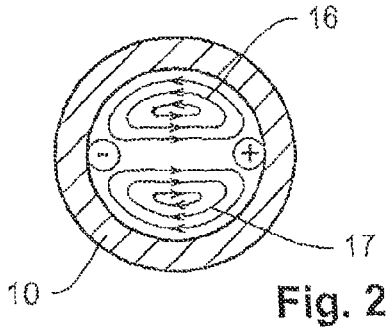
Fig. 2d
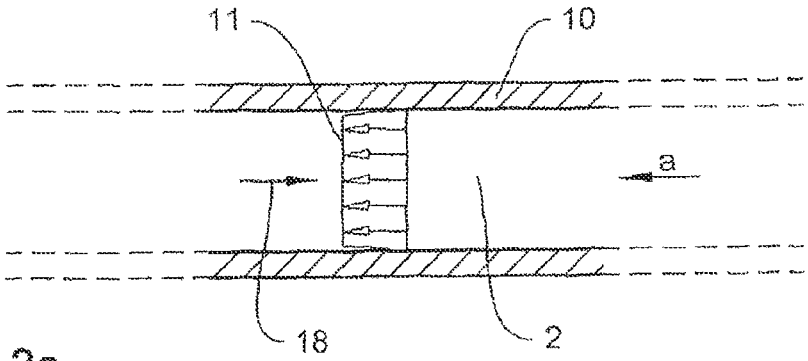
Fig. 2e Fig. 3c
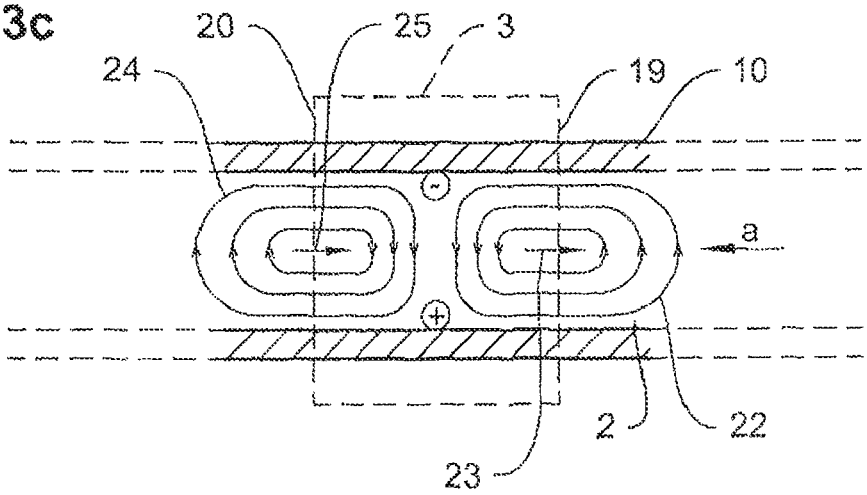
Fig. 3d
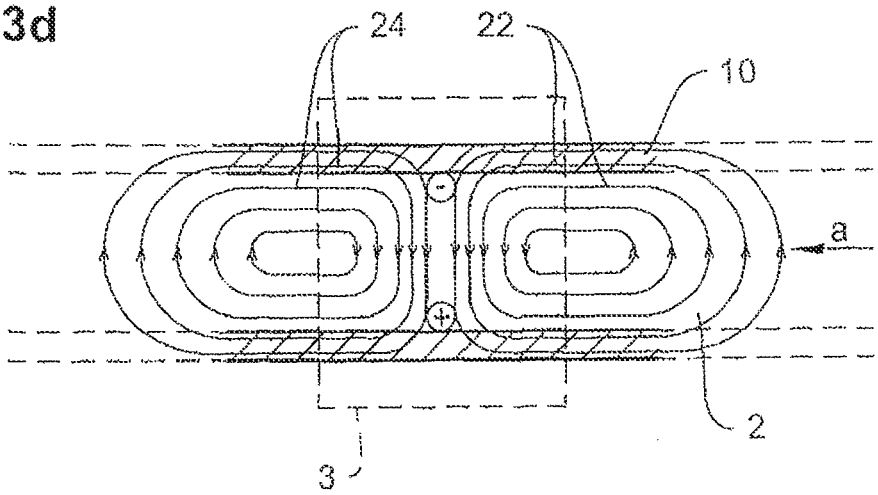
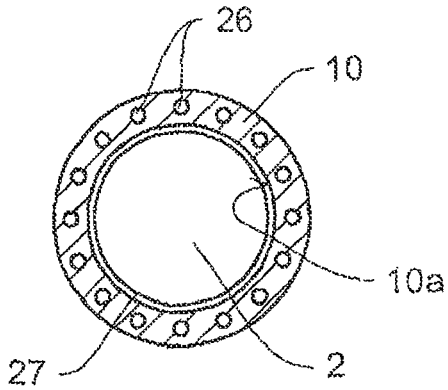
Fig. 4

Fig. 8
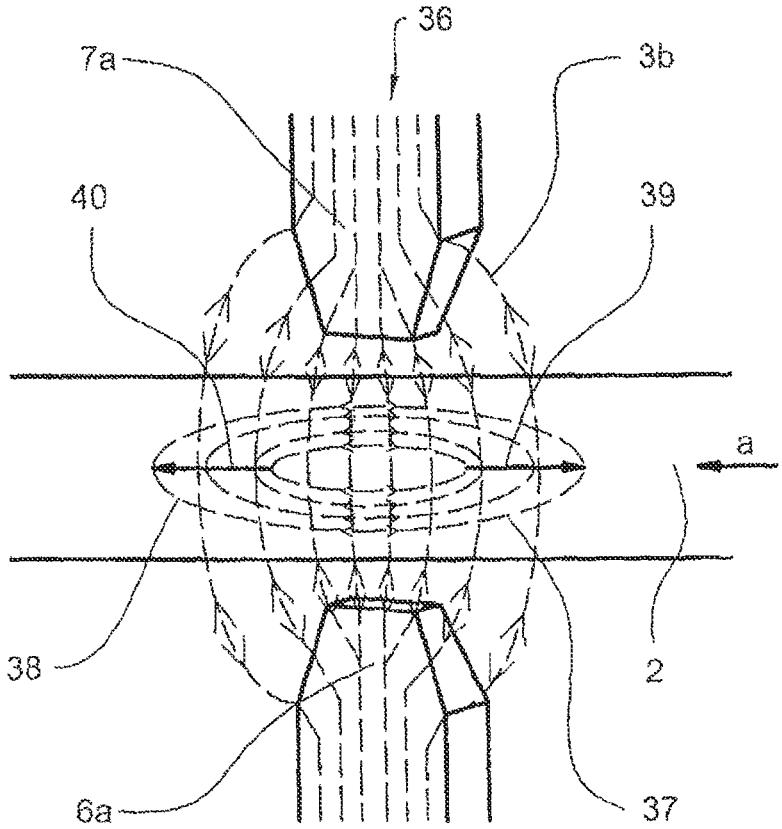
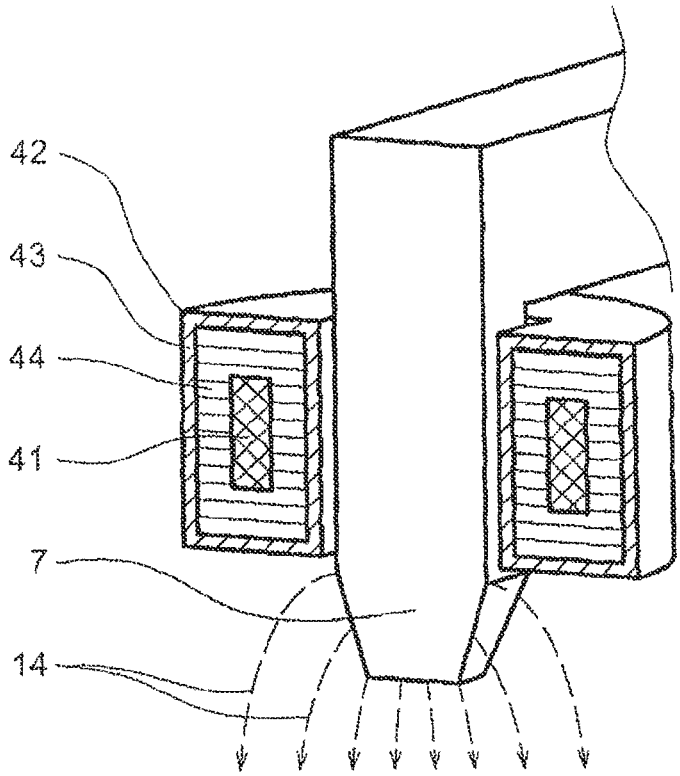
Fig. 9

Fig. 12b
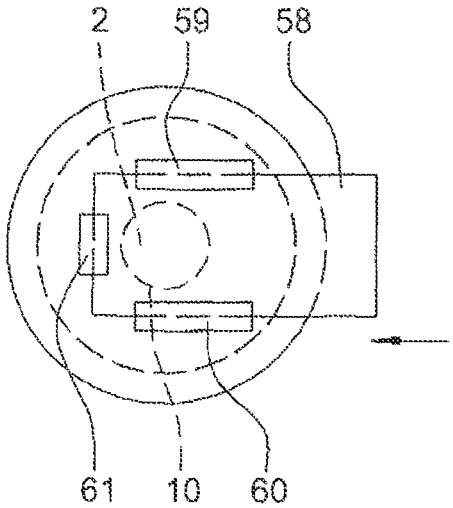
Fig. 12a
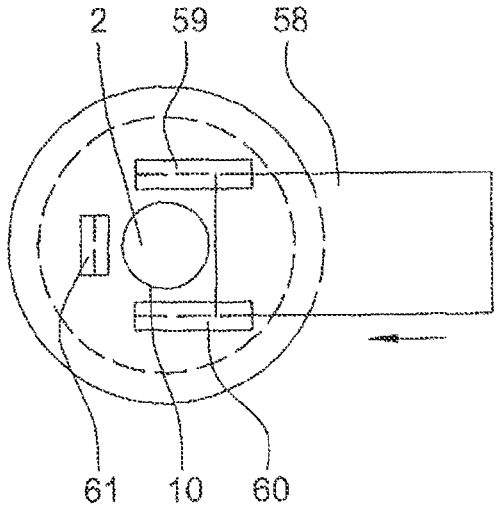
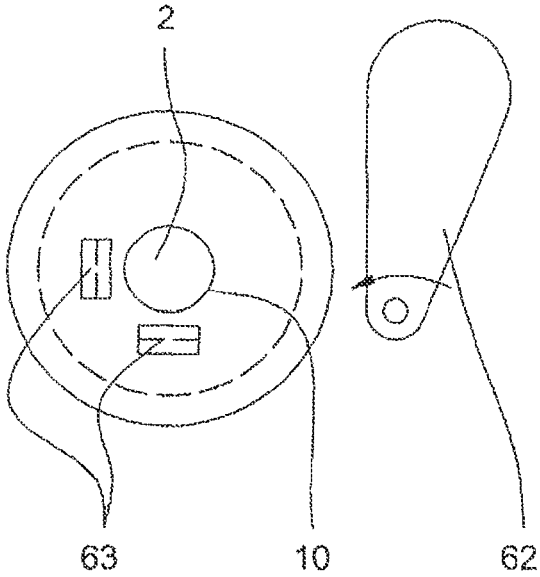
Fig. 13a
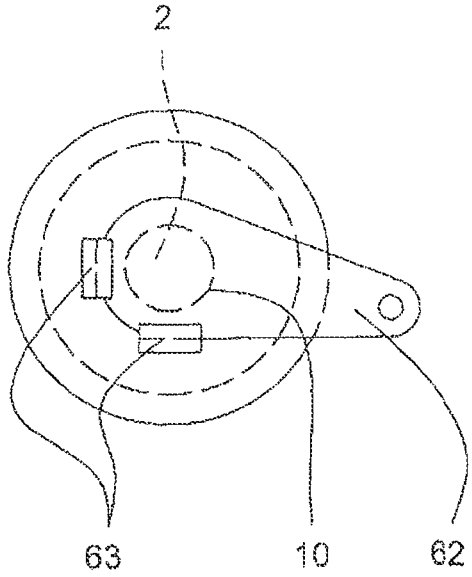
Fig. 13b

Fig. 16
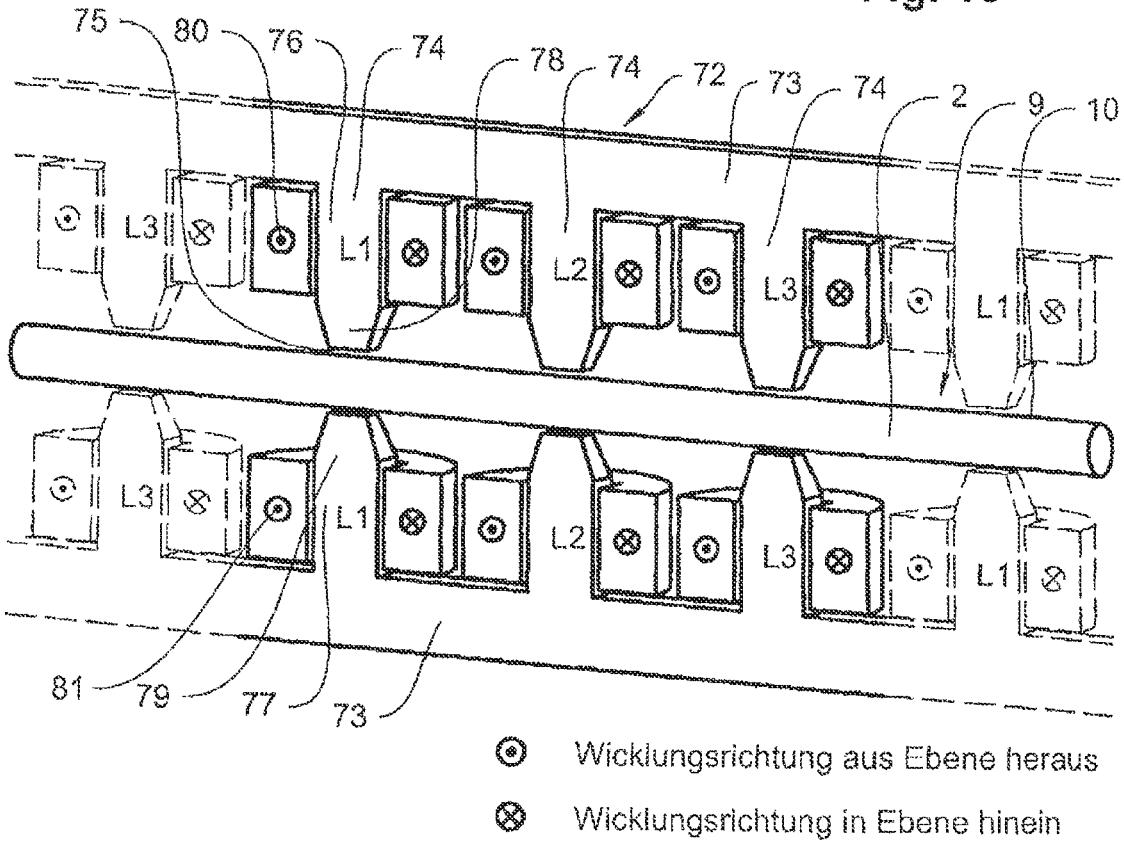
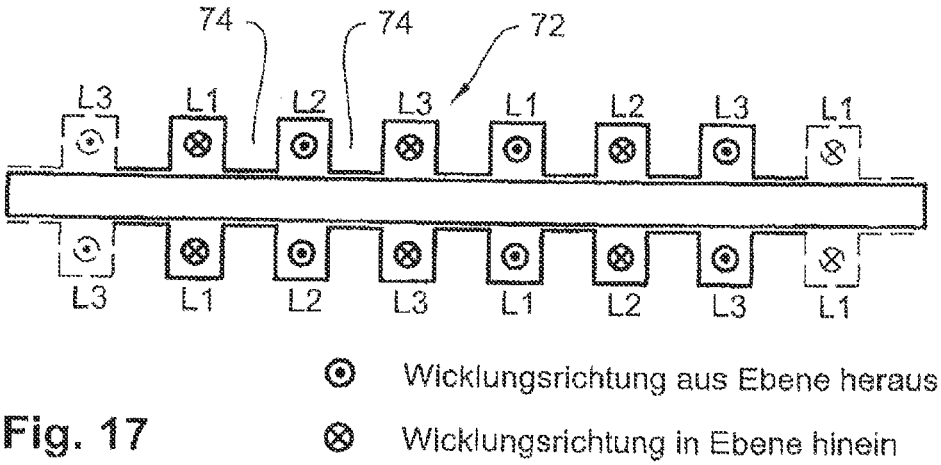
Fig. 17

METHODS AND DEVICES FOR REGULATING THE FLOW RATE AND FOR SLOWING DOWN NON-FERROMAGNETIC, ELECTRICALLY CONDUCTIVE LIQUIDS AND MELTS

CROSS-REFERENCE TO RELATED APPLICATIONS

This is a Continuation Application of U.S. patent application Ser. No. 13/057,378 filed Mar. 30, 2011 currently pending, which claims the benefit of German Patent Application No. DE 10 2008 036799.0 filed Aug. 7, 2008, German Patent Application No. 10 2009 035 241.4 filed Jul. 29, 2009 and is a national stage application of PCT International Application No. PCT/EP2009/060216 filed on Aug. 6, 2009, all of which are incorporated herein by reference.

DESCRIPTION

The invention pertains to methods and devices for regulating the flow rate and for decelerating non-ferromagnetic, electrically conductive liquids and melts by means of electric magnetic fields while said liquids and melts flow through a channel-like or pipe-like guide element, particularly when tapping metallurgical containers such as blast furnaces and melt furnaces.

DE 2 023 901 and DE 2 101 547 describe an electromagnetic valve or electromagnetic pump that surrounds a tapping pipe, wherein this tapping pipe is connected to a discharge opening in the bottom region of a container for accommodating a melt and directed obliquely upward. The pump consists of one or more electromagnetic coils that are supplied with a polyphase current and generate a traveling magnetic field with a direction that is dependent on the phase sequence in the melt stream flowing through the tapping pipe, wherein this traveling magnetic field exerts a force upon the melt stream in or opposite to the flow direction in order to regulate the discharge rate of the melt stream.

DE 1 949 982 and DE 2 248 052 disclose an electromagnetic conveying channel for discharging liquid metal from a melt furnace or holding furnace, wherein said conveying channel features an obliquely ascending channel body that leads into the furnace with its lower end. An inductor that consists, for example, of the stator winding of a three-phase linear motor is arranged underneath the channel body in order to generate a traveling electromagnetic field that causes an open flow of liquid metal opposite to the gravitational force in the channel body of the conveying channel.

These electromagnetic pumps according to the state of the art for discharging metal melts from metallurgical containers through flow channels or conveying channels and for regulating the discharge rate of the melt streams operate with traveling electromagnetic fields generated by electric coil arrangements that surround closed drain channels realized, for example, in the form of pipes or are arranged underneath the conveying channels when open conveying channels are used for the melt streams. In order to generate such traveling electromagnetic fields, an elaborate arrangement of several electric coils needs to be provided over a significant length of the drain channels or the conveying channels, respectively.

DE 2 333 802 discloses an electrodynamic metering device for metal melts that is intended for foundries in order to discharge small quantities of melts. The forces generated in a melt stream with such a metering device are far from sufficient for stopping or even decelerating a melt stream in the taphole channel of a blast furnace.

DE 1 949 053 discloses an electromagnetic valve for influencing the flow rate and the flow direction of a metal or metal alloy melt in a tubular channel. The function of the valve is based an external electric current flowing through the melt stream that flows through the channel while the melt stream is simultaneously subjected to an external magnetic field, namely such that a force directed in or opposite to the flow direction of the melt stream is exerted upon the section of the melt stream that is situated in the channel and subjected to a magnetic field. This electromagnetic metering valve is merely intended for induction channels in annular furnaces and discharge channels of melt furnaces and pouring ladles. Another disadvantage of this metering valve can be seen in that electrodes are required for feeding the electric current into the melt stream, wherein these electrodes are in direct contact with the melt and therefore subjected to significant wear.

A conduit pipe is used in the tapping method for blast furnaces known from DE 694 19 598 T2, wherein this conduit pipe is connected to the outside of an iron melt taphole and electromagnetic coils are arranged on the outer surface of the conduit pipe in order to generate an alternating magnetic field that acts upon the iron melt and the slag melt flowing through the conduit pipe. This device is designed for attaining two objectives:

1. The generation of a rotary field by means of the electromagnetic coils analogous to a three-phase electric motor is supposed to cause a rotational movement of the melt stream in the taphole channel of the blast furnace in order to separate the pig iron and the slag in accordance with the centrifuge principle. The disadvantage of this solution is the mutual superposition of the normal discharge speed and the rotational speed of the melt stream such that the wear in the taphole channel increases significantly due to the higher speed of the melt stream and the centrifugal force acting upon the melt stream. In this case, it is not possible to stop or even just to decelerate the melt stream.

2. A force is supposed to be exerted in the direction of the center axis of the taphole channel, namely such that the pig iron and the slag are once again separated from one another and the pig iron flow furthermore is retarded and decelerated due to the reduction of the cross-sectional area of the taphole channel caused by the slag stream in the outer region of the taphole channel. In addition to the poor efficiency, another disadvantage of this solution is the fact that essentially only the outer layer of the iron melt/slag stream in the taphole channel is influenced by the alternating magnetic field and the magnetic field lines cannot or only be weakly conducted into the inner layers of the melt/slag mixture, particularly into the central region of the melt/slag stream around the center axis of the taphole channel. Due to hydrodynamic effects, the highest flow rate and flow pressure occur, in particular, in this central region of the melt/slag stream. The stream is only decelerated indirectly due to the reduction of the flow cross section of the taphole channel for the iron melt and, in principle, only in the outer layers and therefore incompletely. It is not possible to completely stop the melt stream.

One common aspect of these two solutions is that they only function with alternating magnetic fields.

DE 2 110 401 describes the continuous tapping of pig iron from a blast furnace by means of an A.C. magnetic pump that is arranged around a tubular drain channel positioned downstream of the tapping channel. The magnetic pump generates a traveling magnetic field that axially shifts in one direction or in the opposite direction in a linear fashion in the pig iron drain channel. The traveling magnetic field exerts the cooling effect upon the liquid pig iron in the drain channel. Depending on the respective circumstances and requirements, the flow of the pig iron can be accelerated, throttled or even stopped by means of the A.C. magnetic pump.

In this magnetic pump, the windings of the induction coils extend concentrically around the drain channel. Although this coil arrangement provides certain advantages with respect to the resulting volumetric flow rate in the conveying of electrically conductive mediums, it is not practical for stopping a melt stream because the magnetic field strength and therefore the resulting retention forces are inevitably weaker in the center of the drain channel, i.e., exactly where the highest pressure of the melt stream occurs due to hydrodynamic effects.

The invention is based on the objective of developing methods and devices for regulating the flow rate and for decelerating a melt stream by means of magnetic fields, particularly when tapping metallurgical containers such as blast furnaces and melt furnaces, wherein the inventive methods and devices eliminate the above-described disadvantages of known methods and devices for regulating the flow rate of melt streams and, due to the effect of magnetic forces, make it possible to generate a deceleration effect that directly acts upon a melt stream over its entire flow cross section until the melt stream comes to a standstill. This should be achieved with induced eddy currents only such that the devices operate in a completely contactless fashion and wear-prone contacts for the infeed of an electric current are avoided.

According to the invention, this invention objective is attained with with a regulating device for regulating the flow rate and for decelerating non-ferromagnetic melt streams, particularly in the tapping of metallurgical containers such as blast furnaces or melt furnaces. The regulating includes a core of ferromagnetic material with two poles that form a gap; a guide element for the melt stream arranged between the two poles; and induction coils arranged on the core and generating a stationary magnetic field with constant polarity that acts upon the melt stream in the guide element arranged between the two poles. In another embodiment, a regulating device for regulating the flow rate and for decelerating non-ferromagnetic melt streams until they come to a standstill incorporating the invention includes at least one core of ferromagnetic material with an in-line arrangement of several pole pairs that form a gap. Poles of the pole pairs have pole shoes. A guide element for a melt stream is accommodated in the gap between the two poles of the pole pairs. Induction coils arranged on the pole shoes of the poles of the pole pairs are supplied with a three-phase current with a singular utilization of the three phases L1, L2, L3 in order to generate a bipolar traveling electromagnetic field or with a three-phase current with a multiple utilization of each phase L1, L2, L3 in order to generate a multipolar traveling magnetic field that acts upon the melt stream in the guide element arranged between the two poles of the pole pairs.

The first inventive method for regulating the flow rate and for decelerating non-ferromagnetic, electrically conductive liquids and melts by means of electric magnetic fields while said liquids and melts flow through a channel-like or pipe-like guide element, particularly when tapping metallurgical containers such as blast furnaces and melt furnaces, is characterized in that the liquid or melt stream is guided in a closed guide element through at least one stationary magnetic field with constant polarity such that the magnetic field lines transversely penetrate the melt stream over its entire cross section, in that voltages, the level of which is proportional to the local flow rate of the melt stream and the local strength of the magnetic field, are induced within the magnetic field perpendicular to the magnetic field lines, in that the voltages generate electric eddy currents that are directed radially and axially referred to the flow direction of the melt stream and have an intensity that locally differs over the flow cross section of the melt stream, wherein forces of locally differing intensity that influence the flow rate of the melt stream are generated due to the interaction between the magnetic field and the eddy currents, and in that the flow profile of the melt stream is homogenized and decelerated as the magnetic field strength increases.

The second inventive method for regulating the flow rate and for decelerating non-ferromagnetic, electrically conductive liquids and melts by means of electric magnetic fields while said liquids and melts flow through a channel-like or pipe-like guide element, particularly when tapping metallurgical containers such as blast furnaces and melt furnaces, is based on guiding the liquid or melt stream in a closed guide element through a stationary alternating magnetic field or through a multipolar traveling electromagnetic field with alternating polarity such that the magnetic field lines transversely penetrate the melt stream over its entire cross section and a voltage is induced in the melt stream and generates in the melt stream axial eddy currents in the direction of the melt stream, and in that forces generated due to the interaction between the magnetic field and the eddy currents are able to reduce and accelerate the flow rate of the melt stream and to stop the melt stream.

In the first method, the greatest forces acting upon the melt stream are generated in the region of the melt stream with the highest flow rate, particularly in the central region of the melt stream.

Due to the interaction of the electromagnetic field with constant polarity, the alternating magnetic field and the traveling electromagnetic field with the eddy currents, a force is generated that lowers the flow rate of the melt stream and simultaneously reduces the turbulences due to an increased magnetic viscosity of the melt.

Due to the interaction of the alternating magnetic field or the alternating magnetic fields with the eddy currents, a force is generated that is directed opposite to the flow direction of the melt stream and can lower the flow rate of the melt stream, as well as stop the melt stream. The melt stream can be stopped and the flow direction of the melt stream can be reversed due to the interaction of a traveling electromagnetic field with the eddy currents.

The forces acting upon the melt stream can be increased or decreased by varying the magnetic field with constant polarity, the alternating magnetic field and the traveling electromagnetic field.

The frequency of the alternating electromagnetic field and the traveling magnetic field, as well as of the electric current generating the magnetic fields, can be varied and adapted to different circumstances.

In the magnetic field with constant polarity and in the traveling magnetic field, the magnetic flux acts upon the melt stream in a decelerating fashion opposite to the flow direction thereof in a closed magnetic circuit when the melt stream enters the magnetic field and when the melt stream exits the magnetic field of the magnetic circuit. In this way, an additive effect is exerted upon the melt stream.

The decelerating effect exerted upon the melt stream can be additionally increased with a series connection of several closed magnetic circuits with a double utilization of the magnetic flux of magnetic fields with constant polarity.

In the melt stream in taphole channels of blast furnaces or in other melt streams that contain liquid metal and slag, the effect of the magnetic fields with constant polarity, the alternating magnetic fields and the traveling electromagnetic fields differs significantly in the liquid metals and in the slags. Consequently, this different effect can also be used for separating liquid metal and slag.

Figure 2F:
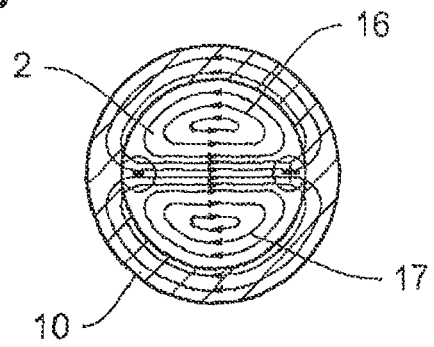
Figure 3A:
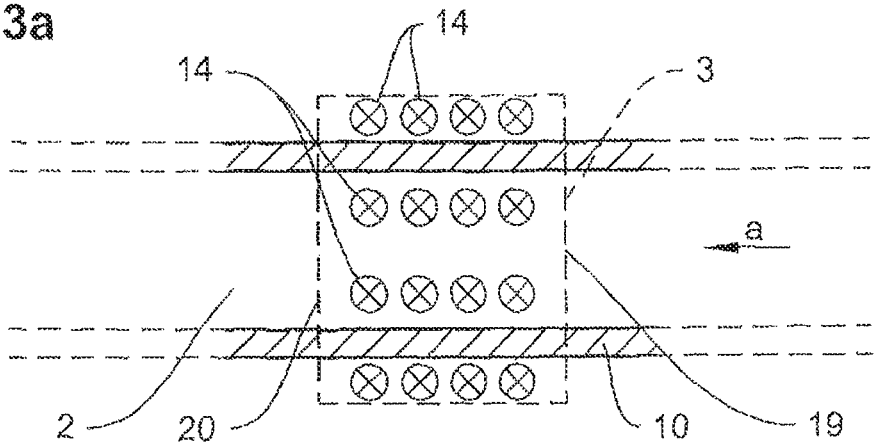
Figure 3B:
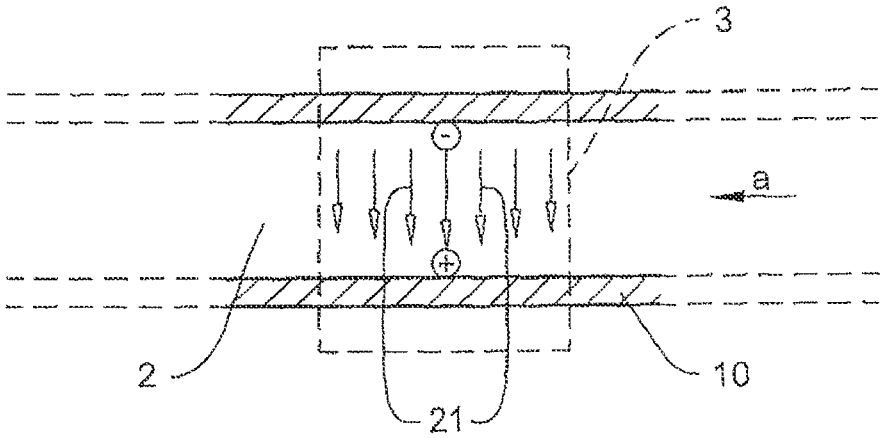
Figure 5:
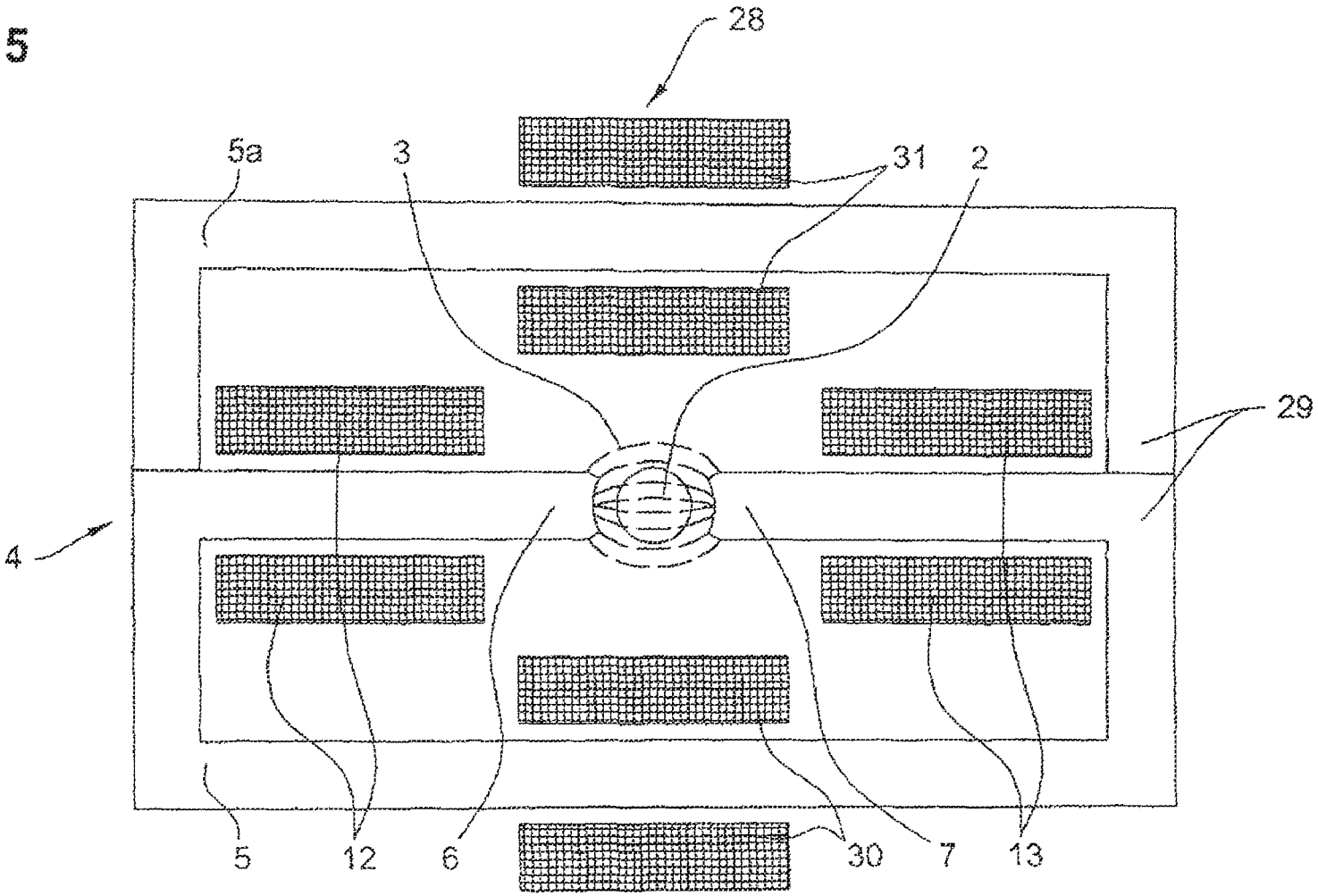
Figure 6:
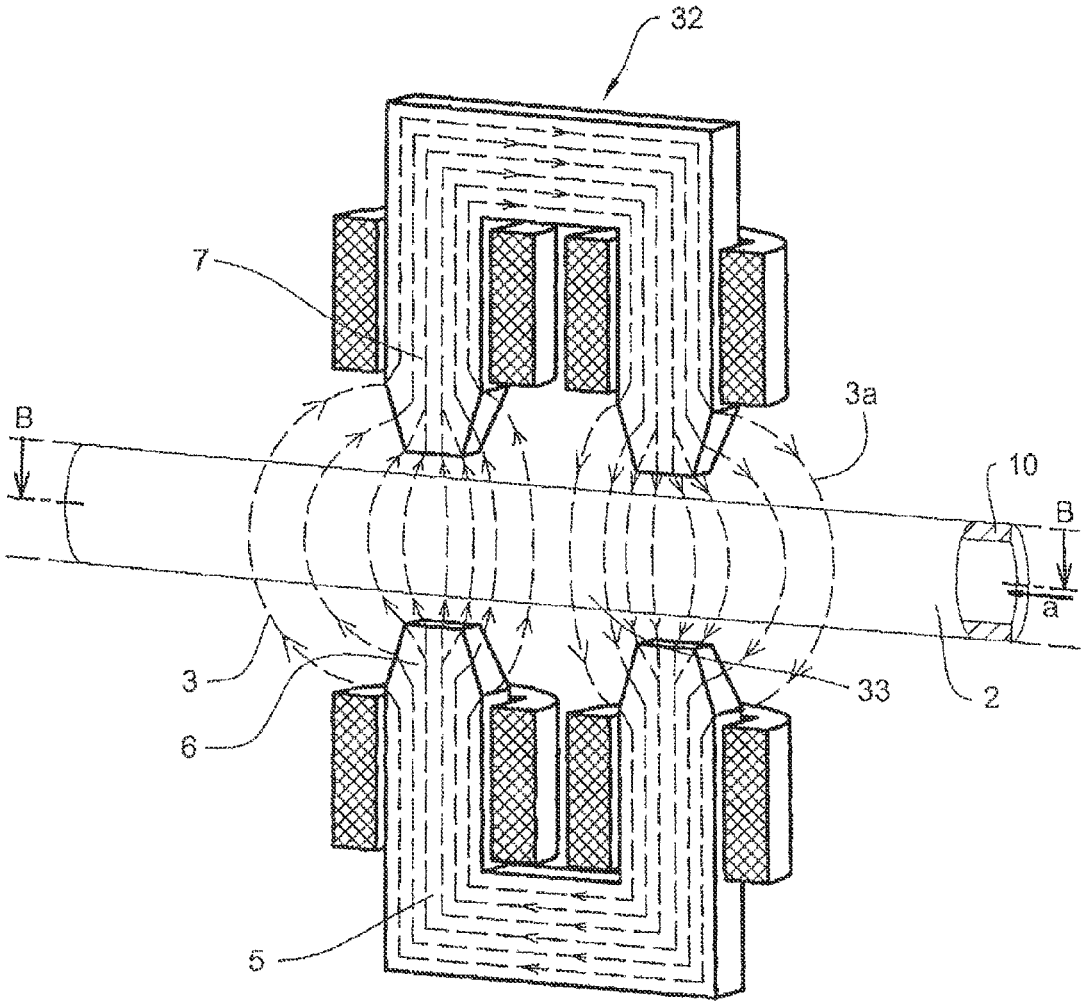
Figure 7A:
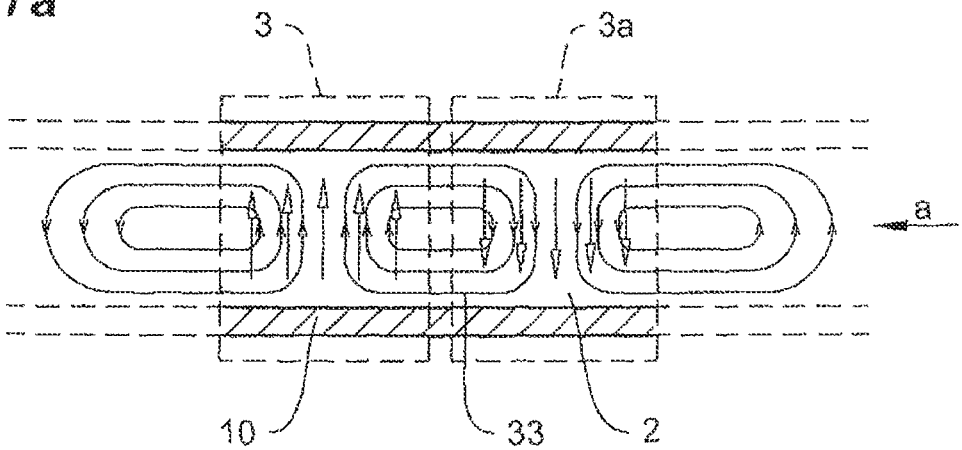
Figure 7B:
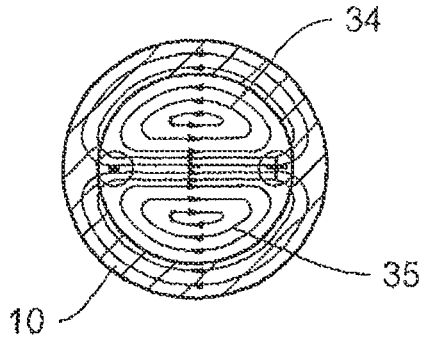
Figure 10:
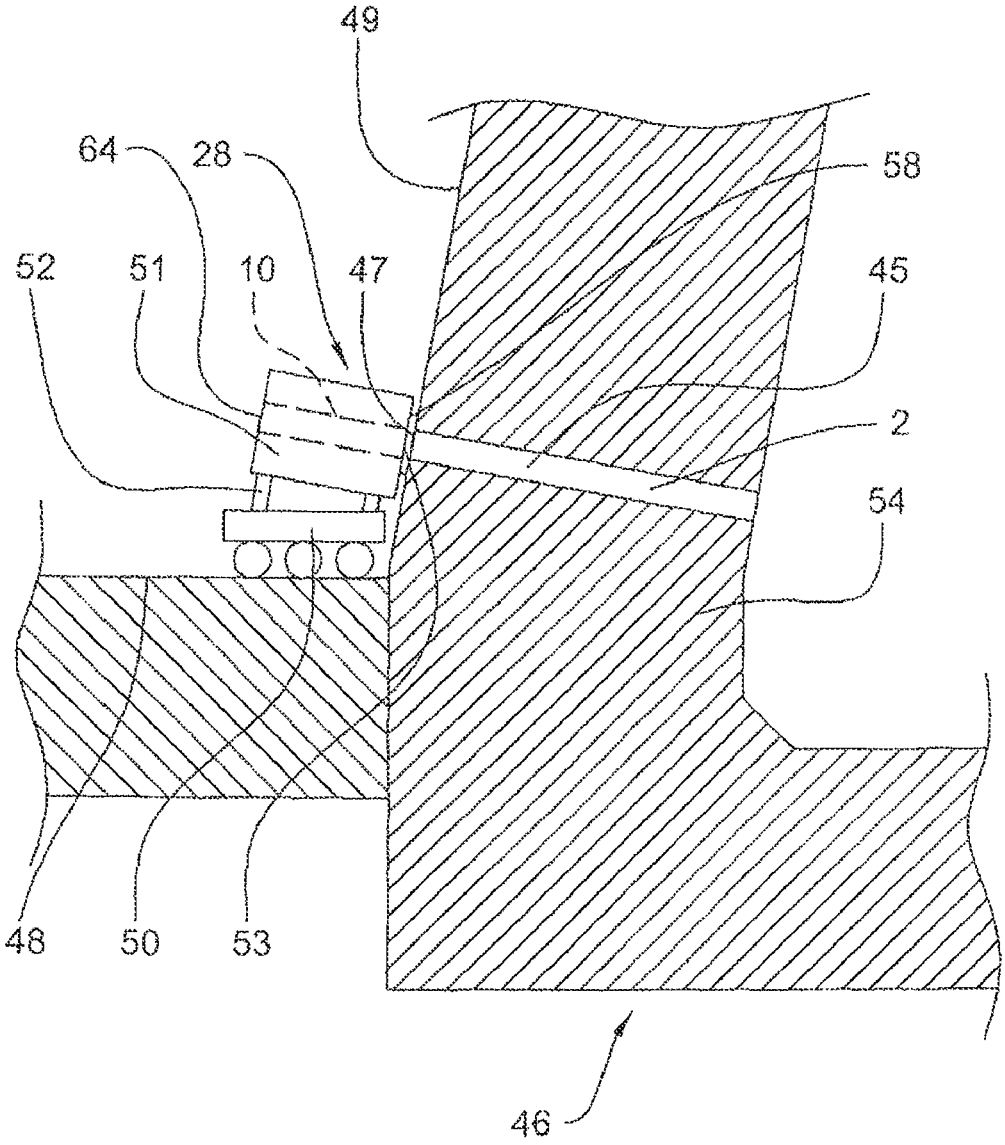
Figure 11:
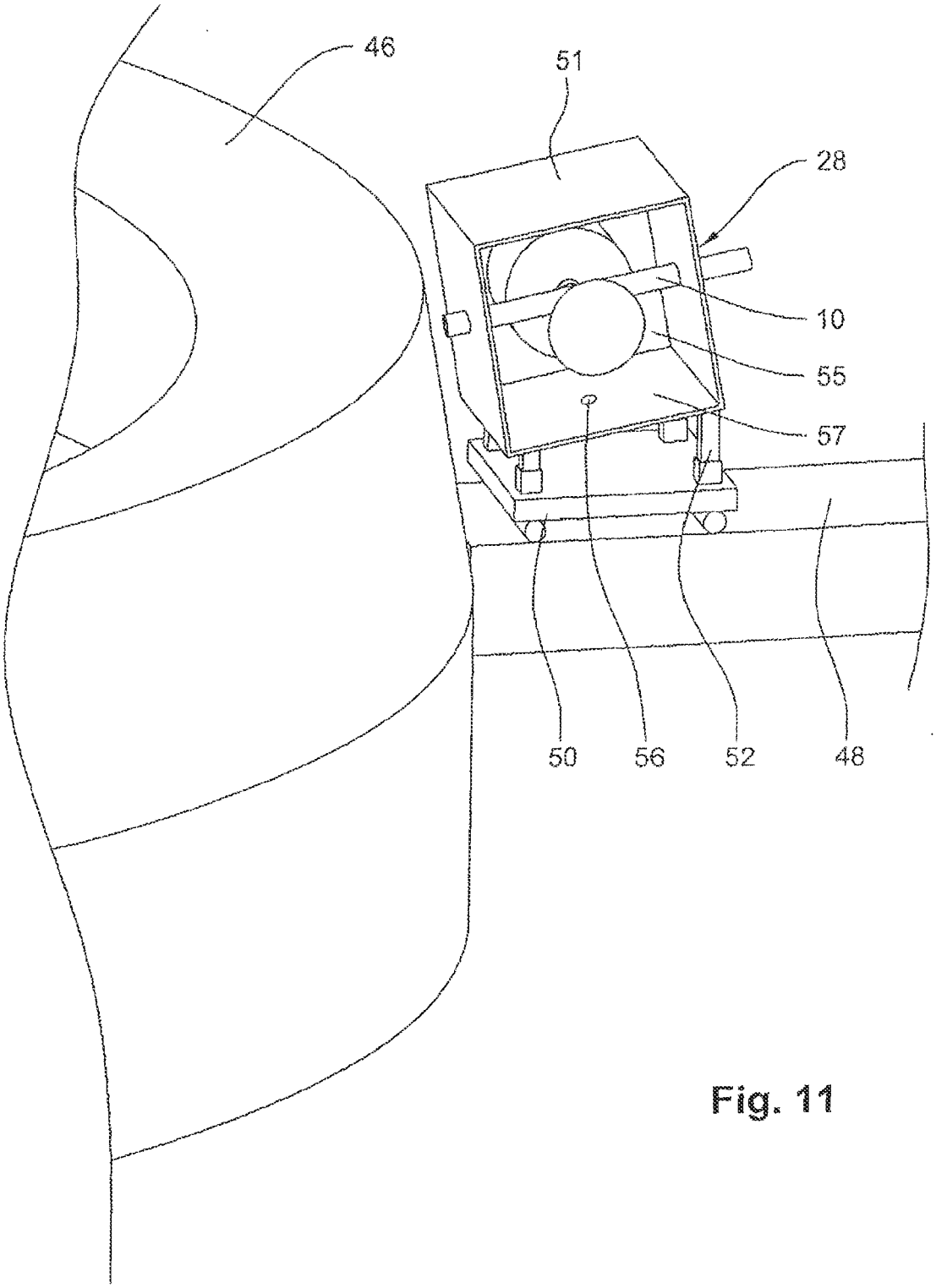
Figure 14:
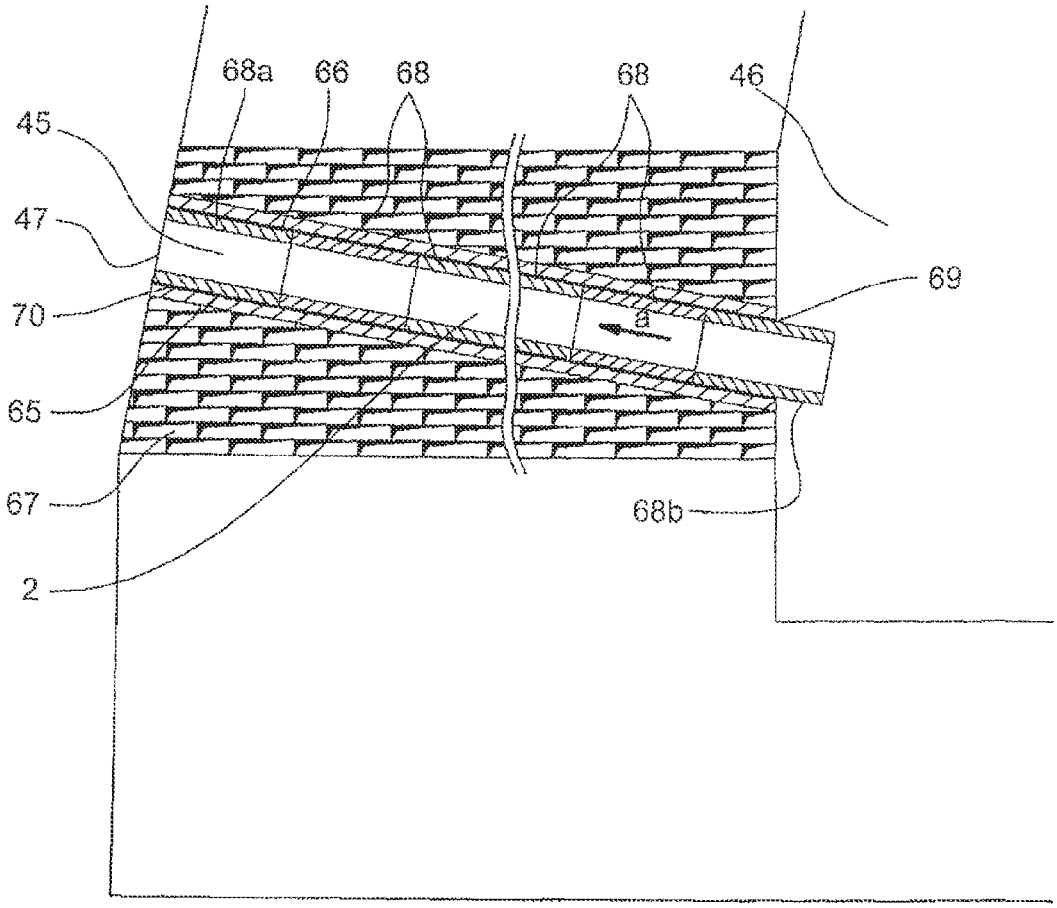
Figure 15:
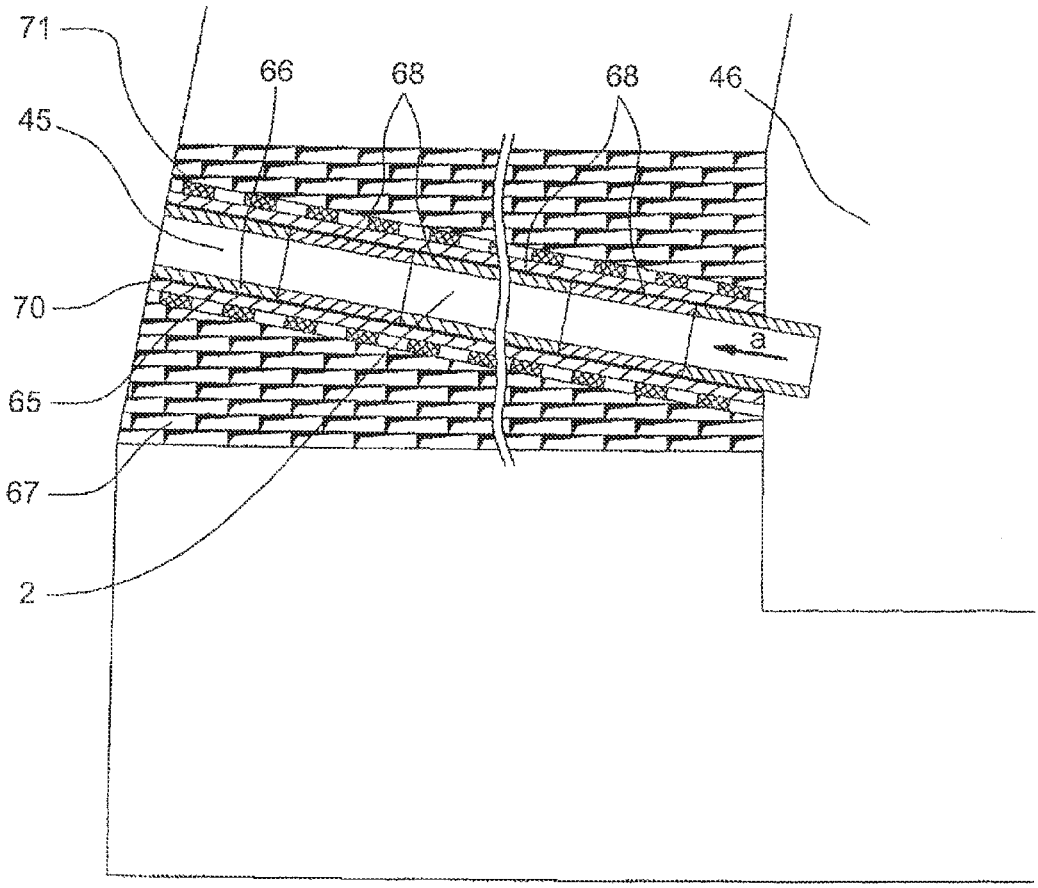
Figure 18A:
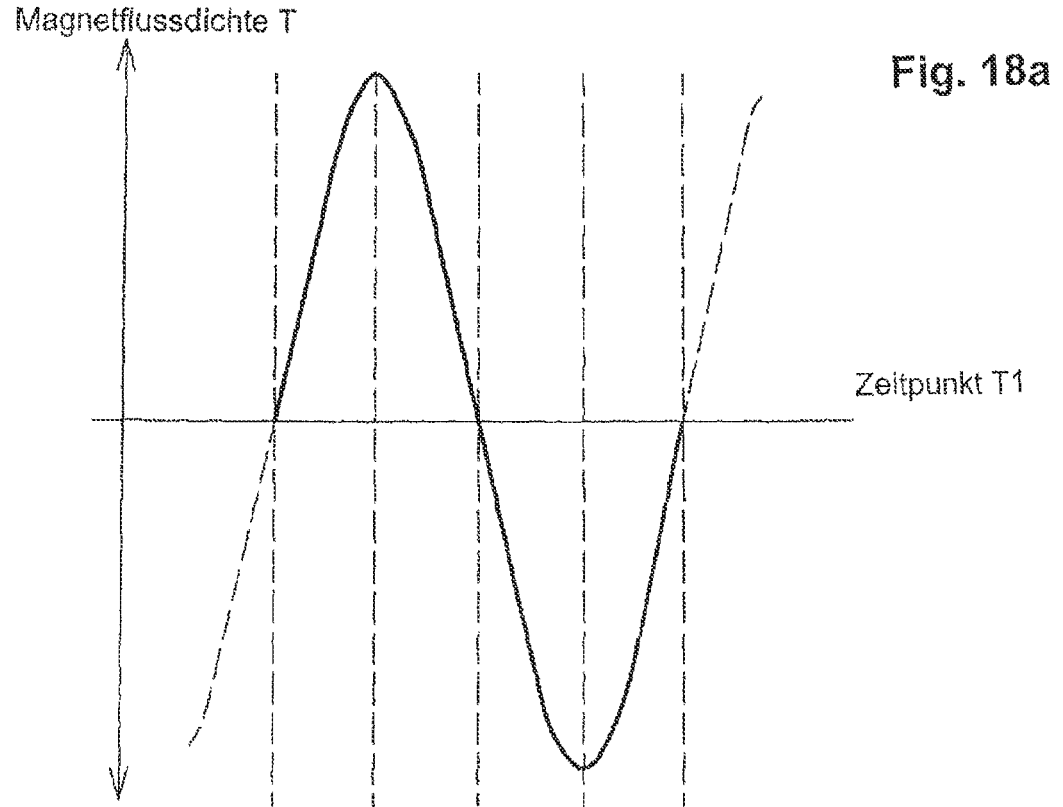
Figure 18B:
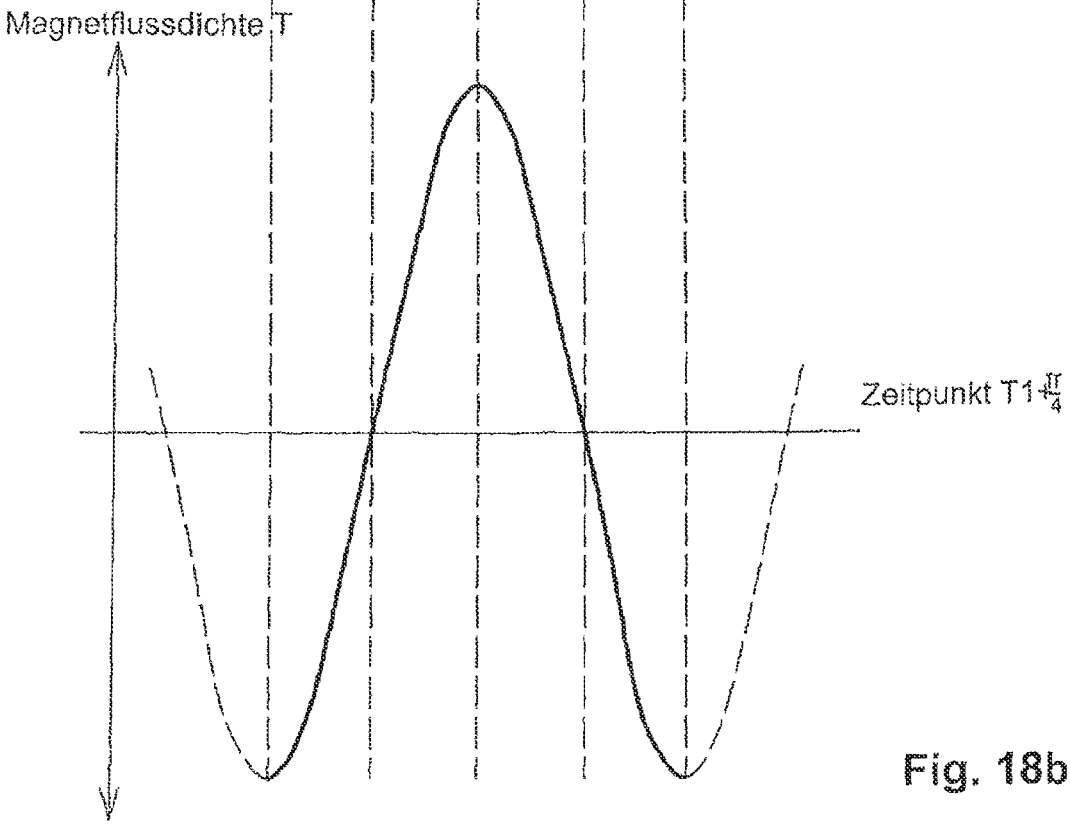

Devices for regulating the flow rate and for decelerating melt streams that operate in accordance with the above-described methods and are used, in particular, in the tapping of blast furnaces are described below with reference to schematic drawings, in which:

FIG. 1 shows a perspective representation of a regulating device with a magnetic field with constant polarity for regulating the flow rate and for decelerating a melt stream, FIG. 2*a* shows a longitudinal section through the conduit pipe of the regulating device with the velocity profile of the melt stream, FIG. 2*b* shows a cross section through the conduit pipe of the regulating device with the magnetic field lines that transversely penetrate the melt stream, FIG. 2*c* shows a cross section through the conduit pipe of the regulating device with the different voltages induced in the melt stream by the magnetic field, FIG. 2*d* shows a cross section through the conduit pipe of the regulating device with the radial eddy currents generated in the melt stream, FIG. 2*e* shows a longitudinal section through a conduit pipe of the regulating device with the velocity profile of the melt stream that was flattened by means of Lorentz forces due to radial eddy currents and magnetic fields, FIG. 2*f* shows a cross section through the conduit pipe of the regulating device with the flow of the radial eddy currents through the melt stream and the wall of the conduit pipe, FIG. 3*a* shows a longitudinal section through the conduit pipe of the regulating device along the line A-A in FIG. 1 with the magnetic field of the regulating device, FIG. 3*b* shows a longitudinal section through the conduit pipe of the regulating device along the line A-A in FIG. 1 with the voltages induced in the melt stream by the magnetic field, FIG. 3*c* shows a longitudinal section through the conduit pipe of the regulating device along the line A-A in FIG. 1 with the axial eddy currents generated in the melt stream, FIG. 3*d* shows a longitudinal section through the conduit pipe of the regulating device with the flow of the axial eddy currents through the melt stream and the wall of the conduit pipe, FIG. 4 shows a cross section through the conduit pipe of a regulating device that is equipped with cooling channels, FIG. 5 shows another embodiment of a regulating device that operates with a magnetic field with constant polarity, FIG. 6 shows a schematic representation of a regulating device with a series connection of two magnetic fields with constant polarity, FIG. 7*a* shows a longitudinal section through the regulating device along the line B-B in FIG. 6 with the generated axial eddy current fields, FIG. 7*b* shows the radial eddy current fields generated with the regulating device according to FIG. 6, FIG. 8 shows a schematic representation of a regulating device that operates with alternating magnetic fields, FIG. 9 shows a schematic representation of an induction coil of superconductive material that is arranged on one pole of the magnet core of a regulating device, FIGS. 10 and 11 show the arrangement of the device for regulating the flow rate and for decelerating a melt stream in front of the outlet opening of the taphole channel of a blast furnace, FIGS. 12*a* and 12*b* show a slide for closing the outlet opening of the taphole channel of a blast furnace in the open position and the closed position, FIGS. 13*a* and 13*b* show a pivoted shutter for closing the outlet opening of the taphole channel in the open position and in the closed position, FIG. 14 shows a taphole channel that is composed of an outer pipe and an inner pipe, FIG. 15 shows the outer and inner pipes of the taphole channel that are equipped with a combined heating and cooling system, FIG. 16 shows a schematic representation of a regulating device that operates with a traveling electromagnetic field, FIG. 17 shows the practical embodiment of the regulating device according to FIG. 16, and FIGS. 18*a* and 18*b* show the profile of the resulting magnetic flux density of the traveling electromagnetic field generated with a three-phase induction coil system of the regulating device according to FIGS. 16 and 17 at two different times.

The regulating device 1 according to FIG. 1 is preferably utilized in the tapping of blast furnaces for regulating the flow rate and for decelerating a melt stream 2 by means of a stationary electric magnetic field 3 with constant polarity and features a core 4 of ferromagnetic material that is realized in the form of a yoke 5 with two poles 6, that form a gap 8 for accommodating a closed guide element 9 in the form of a pipe 10 of an electrically conductive material such as, for example, copper, through which the melt stream 2 is conveyed.

The laminar melt stream 2 flowing through the conduit pipe 10 in the direction of the arrow a has the velocity profile 11 illustrated in FIG. 2*a*.

Two induction coils 12, 13 that operate with a direct current are positioned on the yoke 5 in order to generate the magnetic field 3 with constant polarity between the two poles 6, 7, wherein said magnetic field is indicated in the form of field lines 14 that transversely penetrate the melt stream 2 according to FIG. 2*b* over its entire cross section.

FIG. 2*c* elucidates that voltages 15 of different intensity are induced perpendicular to the field lines 14 of the magnetic field 3 in dependence on the local flow rate of the melt stream 2 due to the velocity profile 11 of the melt stream 2 in combination with the stationary magnetic field 3 with constant polarity, wherein said voltages drop to the value zero in the stationary boundary layer of the melt stream 2.

According to FIG. 2*d*, eddy currents 16, 17 flow radially referred to the flow direction a of the melt stream 2 in order to compensate the electric potential difference. In addition, eddy currents also flow axially referred to the flow direction a of the melt stream 2 as described below.

Due to the interaction of the magnetic field 3 with radial eddy currents 16, 17, so-called Lorentz forces 18 directed opposite to the flow direction a of the melt stream 2 are generated in the melt stream 2. This flattens the velocity profile 11 of the melt stream 2 such that the melt stream is altogether homogenized and decelerated due to the suppression of turbulences as elucidated in FIG. 2*e*.

According to the illustration in FIG. 2*f*, the electrically conductive material of the conduit pipe 10 of the regulating device 1, particularly copper, significantly amplifies the radial eddy currents 16, 17 because the eddy currents not only flow through the melt stream 2, but also through the wall of the conduit pipe 10 in this case. This correspondingly intensifies the deceleration effect exerted upon the melt stream 2.

FIG. 3*a* shows a longitudinal section through the conduit pipe 10 of the regulating device 1 along the line A-A in FIG. 1 with the field lines 14 of the magnetic field 3 that extend perpendicular to the melt stream 2 and in the direction a of the melt stream, wherein said magnetic field extends in and perpendicular to the flow direction a of the melt stream 2.

According to FIG. 3*a*, the melt stream 2 enters the magnetic field 3 in the region 19 and exits the magnetic field in the region 20. When the melt stream 2 enters the magnetic field 3, a voltage 21 that is illustrated in FIG. 3*b* is induced in the melt stream in a plane that lies perpendicular to the magnetic field lines 14, wherein eddy currents 22 according to FIG. 3*c* are generated in the melt stream 2 in accordance with Lenz's law in order to compensate the potential difference. The eddy currents 22 flow axially referred to the flow direction a of the melt stream 2 and as far as outside the region of the magnetic field 3.

Lorentz forces 23 are generated in the melt stream 2 due to the interaction of the magnetic field 3 with eddy currents 22, wherein these forces are directed opposite to the flow direction a of the melt stream 2 and thusly exert a deceleration effect upon the melt stream 2 such that the flow rate of the melt stream is lowered.

When the melt stream exits the magnetic field 3 in the exit region 20, eddy currents 24 are generated in the melt stream 2 and once again generate Lorentz forces 25 due to their interaction with the magnetic field 3, wherein these forces are directed opposite to the flow direction a of the melt stream 2 and therefore trigger another deceleration effect in addition to the deceleration effect of the Lorentz forces 23 in the region 19, in which the melt stream 2 enters the magnetic field 3.

Lorentz forces 18, 23, 25 that exert a significant deceleration effect upon the melt stream 2 are generated due to the interaction of the radial eddy currents 16, 17 and the axial eddy currents 22, 24 with the magnetic field 3.

According to the illustration in FIG. 3*d*, the electrically conductive material of the conduit pipe 10 of the regulating device 1, particularly copper, significantly amplifies the axial eddy currents 22, 24 because the eddy currents not only flow through the melt stream 2, but also through the wall of the conduit pipe 10 in this case. This correspondingly intensifies the deceleration effect exerted upon the melt stream 2.

According to FIG. 4, the conduit pipe 10 of the regulating device 1 that is manufactured of a material with adequate electric connectivity such as copper features cooling channels 26, through which a cooling medium is conveyed in order to prevent the conduit pipe from being attacked by the liquid melt of the melt stream 2.

Due to the aforementioned cooling effect, a solidified melt layer 27 of the melt stream 22 deposits on the inner wall 10*a* of the conduit pipe 10 and acts as a protective layer that protects the conduit pipe 10 from wear. In case wear causes the melt layer to become thinner at any location, a local solidification of the melt immediately occurs because the cooling effect exerted upon the melt is intensified at the respective location due to the reduced wall thickness of the pipe such that the protective layer is restored. This prevents the inner wall 10*a* of the conduit pipe 10 from being subjected to wear by the melt stream 2.

The method and the device for regulating the flow rate and for decelerating the melt stream make it possible to prolong the casting process on blast furnaces and to lower the flow rate of the melt stream in such a way that a permanent tapping process can be realized and the sealing and reopening of the tapholes ultimately can also be eliminated.

Since the deceleration effect of the Lorentz forces is proportional to the flow rate of the melt stream, the turbulences that cause a local increase of the flow rate are reduced in the melt stream being discharged.

In order to exert the most intensive effect of the magnetic fields possible upon the melt stream and to optimize the efficiency of the regulating device, the geometric dimensions of the structural components of the regulating device need to fulfill the following requirements:

The gap between the melt stream 2 conveyed in the conduit pipe 10 and the ends of the two poles 6, 7 needs to be as small as possible. This applies analogously to the wall thickness of the pipe 10, wherein the wall thickness of the pipe must fulfill the safety requirements for discharging and conveying extremely hot melt streams 2. If the new method for regulating the flow rate and for decelerating melt streams by means of magnetic fields is combined with the conventional taphole technique for tapping blast furnaces, the distance from the ends of the poles 6, 7, as well as the diameter of the conduit pipe 10, needs to be chosen such that the devices of a taphole plugging machine, as well as the drill bit and the drill rod for opening the taphole channel, can be guided through the conduit pipe 10 in the gap 8 between the ends of the two poles 6, 7 of the magnet core or the yoke 5, respectively.

FIG. 5 shows another embodiment 28 of the regulating device for generating electric magnetic fields with constant polarity, wherein the core 4 of this regulating device is realized in the form of a double yoke 29 with two yokes 5, 5*a*, on which four induction coils 12, 13, 30, 31 are arranged, in order to amplify the magnetic field 3.

FIG. 6 shows a regulating device 32 with a series connection of two electromagnetic fields 3, 3*a* with constant polarity, by means of which a central axial eddy current field 33 is generated that has a significantly increased current intensity and is illustrated in FIG. 7*a* in the longitudinal section along the line B-B in FIG. 6, wherein this central axial eddy current field is additionally amplified by the radial eddy current fields 34, 35 illustrated in FIG. 7*b* such that the overall efficiency and the deceleration effect exerted upon the melt stream by the regulating device are significantly increased.

In the device 36 according to FIG. 8 for regulating the flow rate, for decelerating and for stopping a melt stream 2 and for reversing the flow direction a of the melt stream 2, an alternating electromagnetic field 3*b* is generated between the two poles 6*a*, 7*a* by means of the not-shown induction coils that are arranged on the poles 6*a*, 7*a* and operated with an alternating current. Eddy currents 37, 38 are induced in the melt stream 2 within the alternating magnetic field 3*b* and generate Lorentz forces 39, 40 that act in a repulsive fashion due to their interaction with the alternating magnetic field 3*b*.

The design of the regulating device 36 with an alternating magnetic field 3*b* according to FIG. 8 corresponds to the design of the regulating device 1 with a magnetic field 3 with constant polarity according to FIG. 1.

When influencing melt streams by means of alternating magnetic fields, a variation of the frequency of these fields and of the electric current generating the magnetic fields makes it possible to vary and therefore adapt the eddy currents and the Lorentz forces to different circumstances.

The induction coils may be manufactured of superconductive material. A superconductor provides the advantage that it conducts the electric current without losses. This makes it possible to realize very high current densities in a confined space such that very intense magnetic fields can be generated with a low energy input and a small space requirement, as well as with low costs.

FIG. 9 shows one induction coil 41 of the two induction coils of the regulating device 1 that serve for generating magnetic fields and are realized in the form of superconductors. The induction coil 41 is arranged on a pole 7 of the pole pair 6, 7, from which the magnetic field lines 14 emanate, and preferably manufactured of a high-temperature superconductor material that develops its superconductive properties in a more or less intensively cooled state. The induction coil 41 is installed into a chamber 42 that consists of one or more layers of a highly heat-insulating material 43. The induction coil 41 is positioned in the center of the chamber 42 and rests in a cooling bath 44 of liquefied gas, preferably nitrogen, that is maintained at its boiling point that must lie below the critical temperature of the superconductive material of the induction coil 41 by the cold temperatures created during its evaporation. Since the liquefied gas is consumed over time due to the evaporation, the chamber needs to be refilled with liquid depending on the consumption. The superconductive induction coil is respectively charged with an electric current and discharged by means of an electric switching device according to requirements.

FIG. 10 shows the arrangement of the regulating device 28 for generating deceleration forces that act upon a melt stream in the taphole channel 45 of a blast furnace 46 by means of electric magnetic fields with constant polarity in front of the outlet openings 47 of the taphole channel 45 in the form of an attachment, wherein the taphole channel is connected to the conduit pipe 10 of the regulating device 28. A table 50, on which the regulating device 28 is arranged in the form of a closed box 51 according to FIG. 11, can be displaced on the working platform 48 on the outer wall 49 of the blast furnace 46. Adjusting devices 52 make it possible to position the box 51 of the regulating device 28 such that the axis of the taphole channel 45 extends coaxial to the axis of the conduit pipe 10 of the regulating device 28, through which the melt stream 2 is conveyed.

If the regulating device 28 is used on blast furnaces in combination with the conventional taphole technique, the outlet opening 47 of the tapping channel 45 and the inlet opening 43 of the conduit pipe 10 of the regulating device for decelerating the melt stream 2 are initially connected to one another in a sealed fashion and the taphole channel 45 in the wall 54 of the blast furnace 46 is subsequently drilled open with a conventional drill through the conduit pipe 10 of the regulating device 28.

In the regulating device 28 according to FIG. 5 that is illustrated in FIGS. 10 and 11, the double yoke 29 for guiding and managing the magnetic flux that, according to FIG. 5, is generated by the four induction coils 12, 13, 30, 31 is realized in the form of a closed box 51 that encloses all components of the regulating device. The front side of the box 51 is removed in the schematic representation according to FIG. 11.

The free space 55 of the closed box 51 that accommodates the induction coils 12, 13, 30, 31 and the conduit pipe 10 is filled with a fine-grained, free-flowing material, preferably sand, in order to also prevent damages to the two yokes 5, 5*a* of the double yoke 29 and to the induction coils 12, 13, 30, 31 in case cracks are created in the conduit pipe 10 due to operational malfunctions such that liquid pig iron or slag can escape within the box 51.

The escaping melt is contained by the sand and solidifies. The sand can be removed through a drain opening 56 in the bottom 57 of the box 51.

FIGS. 12*a* and 12*b* show a mechanical slide 58 that, according to FIG. 10, is arranged between the outlet opening 47 of the taphole channel 45 of a blast furnace 46 and the inlet opening 53 of the conduit pipe 10 of the device 28 for regulating the flow rate and for decelerating the melt stream 2 being discharged from the taphole channel 45. The slide 58 consists of highly temperature-resistant material and is lined with refractory ceramics on its inner side, wherein said slide is held and guided in lateral guides 59, 60 and locked in the closed position by a stop 61 that overlaps the slide 58. The slide 58 is closed when the melt stream 2 in the conduit pipe 10 is decelerated or nearly stopped due to the effect of the magnetic fields. In this way, the melt stream 2 being discharged from the taphole channel 45 under the internal pressure of the blast furnace 46 can be interrupted for an extended period of time after the deceleration by means of the magnetic fields of the regulating device 28. In case the melt retained in the taphole channel solidifies, it can be re-melted with heating devices of the type described below with reference to FIG. 14 in order to initiate another tapping process.

FIGS. 13*a* and 13*b* show a shut-off element for interrupting the melt stream 2 in the form of a pivoted shutter 62 that is lined with refractory material on its side that faces the taphole channel 45. The pivoted shutter 62 is held in the closed position, in which it is pivoted in front of the taphole channel 45, by means of stops 63.

The slide 58 according to FIGS. 12*a* and 12*b* and the pivoted shutter 62 according to FIGS. 13*a* and 13*b* may be arranged between the outlet opening 47 of the taphole channel 45 and the inlet opening 53 of the conduit pipe 10 of the regulating device 28 for regulating the flow rate and for decelerating the melt stream 2 in the taphole channel 45, as well as in front of the outlet opening 64 of the conduit pipe 10 of the regulating device 28.

The taphole channel 45 of the blast furnace 46 illustrated in FIG. 14 is composed of an outer pipe 65 and an inner pipe 66 that can be axially displaced therein, wherein the outer pipe 65 is rigidly connected to the lining 67 of the blast furnace 46. Both pipes 65, 66 consist of a highly refractory material, preferably ceramic material, and the material of the inner pipe 66 that serves for impeding the abrasive wear caused by the pig iron and the slag being discharged is also resistant to abrasion.

The inner pipe 66 consists of pipe sections 68 that are replaced with new pipe sections 68*a* within certain time intervals in order to compensate the occurring abrasive wear, wherein the inner pipe sections 68*a* are pushed into the outer pipe 65 opposite to the flow direction a of the melt stream 2 through the outlet opening 47 of the taphole channel 45 and worn out pipe sections 68*b* are simultaneously pushed out of the outer pipe 65 and into the blast furnace 46 through the inlet opening 69 of the taphole channel 45. The inner pipe section 68*b*, through which the melt stream 2 is introduced into the taphole channel 45 of the blast furnace 46, protrudes into the blast furnace by a certain distance in order to protect the outer pipe 65 and the lining 67 of the blast furnace 46 from abrasive wear. This inner pipe section 68*b* fulfills the function of the so-called mushroom formed on the inner side of the blast furnace lining in conventional tapping methods. The time interval between the insertions of new pipe sections 68*a* is chosen such that the destruction of the inner pipe section 68 is prevented and any contact of the slag or the melt with the outer pipe 65 is precluded.

A mineral-based lubricant 70 is situated between the outer pipe 65 and the inner pipe sections 68, wherein this lubricant fully develops its sliding properties at the high temperatures of the iron and slag being discharged.

The outer pipe 65 and the inner pipe 66 of the taphole channel 45 illustrated in FIG. 15 are equipped with a combined heating and cooling system consisting of at least one hollow spiral 71 that is arranged on the outer pipe 65 and consists of an electrically conductive materials, preferably copper, wherein a cooling medium that flows through the spiral 71 causes a solidification of the melt retained in the taphole channel 45 subsequent to a tapping process after the melt stream 2 has been decelerated by means of the magnetic fields of a regulating device 28 for decelerating the melt stream, and wherein the spiral 71 that is connected to a high-frequency alternating current with high current intensities generates high eddy currents in the melt that has solidified in the taphole channel 45 in order to re-melt the solidified melt.

This taphole channel concept makes it possible to utilize the previously feared effect of a melt stream solidifying or freezing in the taphole channel during a tapping process in a positive way for closing the taphole channel and for generating high eddy currents, preferably in the outer circumferential region of the pig iron plug in the taphole channel, in order to melt the plug and to initiate another tapping process. The melting begins on the boundary surface of the plug that has solidified in the taphole channel to the inner wall of the taphole channel such that the plug is pressed out of the taphole channel by the internal pressure of the blast furnace before the plug is completely melted down to the core.

According to FIG. 16, the device 72 for regulating the flow rate and for decelerating a non-ferromagnetic melt stream 2 until it comes to a standstill is characterized by a core 73 of a ferromagnetic material that dampens eddy currents, preferably a transformer plate, by an in-line arrangement of several pole pairs 74 that form a gap 75 for accommodating a guide element for the melt stream 2 in the form of a pipe 10, as well as by induction coils 80, 81 that are arranged on the pole shoes 76, 77 of the poles 78, 79 of the pole pairs 74 and supplied with a three-phase current with a singular utilization of the three phases L1, L2, L3 in order to generate a bipolar traveling electromagnetic field with a maximum and a minimum field intensity.

One disadvantage of the regulating device according to FIG. 16 can be seen in that the amplitude of the field intensity is attenuated in the intermediate positions while the magnetic field travels from one pole pair to the next. In order to prevent or diminish this amplitude attenuation, the regulating device 72 is realized in accordance with the illustration in FIG. 17 in practical applications, namely with a larger number of pole pairs 74 and with a multiple utilization of each phase L1, L2, L3 of the three-phase current in order to generate a multipolar traveling magnetic field with the magnetic flux density profile illustrated in FIGS. 18*a* and 18*b*, in which a double utilization of the eddy current amplification technique described above with reference to FIG. 6 is realized.

The invention claimed is:

1. A regulating device for regulating the flow rate and for decelerating non-ferromagnetic melt streams in the tapping of metallurgical containers of furnaces, said device comprising:

a core of ferromagnetic material with two poles that form a gap;

a guide element for the melt stream arranged between the two poles, said guide element being a conduit pipe of an electrically conductive material; and induction coils arranged on the core and generating a stationary magnetic field with constant polarity that induces eddy currents in the melt stream in the guide element arranged between the two poles to decelerate the melt stream.

2. The regulating device according to claim 1, in which the core is a yoke, on which two induction coils are arranged.

3. The regulating device according to claim 1, in which the core is a double yoke with two yokes, on which four induction coils are arranged.

4. The regulating device according to claim 1, in which the conduit pipe is equipped with cooling channels for conveying a cooling medium.

5. The regulating device according to claim 1, in which the dimensions of the poles of the core and of the gap are adapted to the dimensions of the guide element for the melt stream.

6. The regulating device according to claim 5, in which the gap between the poles of the core and the diameter of the conduit pipe have such dimensions that a drill bit and a drill rod of a taphole drill for opening the taphole channel of a blast furnace, as well as, the corresponding devices of a taphole plugging machine, can be guided through the conduit pipe in the gap.

7. The regulating device according to claim 1, in which the induction coils for generating a magnetic field with constant polarity are superconductors.

8. The regulating device according to claim 7, in which each induction coil is installed into a heat-insulated chamber with a liquefied gas bath for cooling the coil.

9. The regulating device according to claim 1, in which the yoke for guiding and managing the magnetic flux encloses the induction coils in a closed box to enhance magnetic efficiency.

10. The regulating device according to claim 9, in which the free space of the box enclosing the induction coils is filled with free-flowing material.

11. The regulating device according to claim 1, in which the guide element is a conduit pipe connected to an outlet opening of the taphole channel of a blast furnace, wherein melt stream flows out of the taphole channel and into the conduit pipe.

12. The regulating device according to claim 11, including a shut-off element closing the melt stream flow into the conduit pipe.

13. The regulating device according to claim 1, in which the taphole channel of the blast furnace forms part of the guide element, and said taphole channel is composed of an outer pipe and an inner pipe that can be axially displaced therein, wherein the outer pipe is rigidly connected to the lining of the blast furnace and both pipes consist of a highly refractory ceramic material, and wherein the material of the inner pipe is abrasion-resistant.

14. The regulating device according to claim 13, in which the inner pipe consists of pipe sections that are replaced with new pipe sections within certain time intervals in order to compensate the occurring abrasive wear, wherein the new pipe sections are pushed into the outer pipe opposite to the flow direction of the melt stream through the outlet opening of the taphole channel and worn out inner pipe sections are simultaneously pushed out of the outer pipe and into the blast furnace through the inlet opening of the taphole channel.

15. The regulating device according to claim 13, in which the worn out inner pipe section, through which the melt stream is introduced into the taphole channel of the blast furnace, protrudes into the blast furnace by a certain distance in order to protect the outer pipe and the lining of the blast furnace.

16. The regulating device according to claim 13, in which the outer pipe and the inner pipe of the taphole channel are equipped with a cooling system in order to cause a solidification of the melt retained in the taphole channel after the melt stream has been decelerated.

17. The regulating device according to claim 16, in which the outer pipe and the inner pipe of the taphole channel are equipped with a combined heating and cooling system consisting of a least one hollow spiral that is arranged on the outer pipe and consists of an electrically conductive material, wherein a cooling medium that flows through the spiral causes a solidification of the melt retained in the taphole channel subsequent to a tapping process after the melt stream has been decelerated by means of the magnetic fields of a regulating device for decelerating the melt stream, and wherein the spiral that is connected to a high-frequency alternating current with high current intensities generates high eddy currents in the melt that has solidified in the taphole channel in order to re-melt the solidified melt.

18. A regulating device for regulating the flow rate and for decelerating non-ferromagnetic melt streams until they come to a standstill, said device comprising:

at least one core of ferromagnetic material with an in-line arrangement of several pole pairs that form a gap, poles of the pole pairs having pole shoes;

a guide element for a melt stream accommodated in the gap between the two poles of the pole pairs, said guide element being a conduit pipe of an electrically conductive material; and induction coils arranged on the pole shoes of the poles of the pole pairs are supplied with a three-phase current with a singular utilization of the three phases L1, L2, L3 in order to generate a bipolar traveling electromagnetic field or with a three-phase current with a multiple utilization of each phase L1, L2, L3 in order to generate the multipolar traveling magnetic field that induces eddy currents in the melt stream in the guide element arranged between the two poles of the pole pairs to decelerate the melt stream.

19. The regulating device according to claim 18, in which the core is manufactured of a material that dampens eddy currents.

20. The regulating device according to claim 19, in which the core is manufactured of transformer plates.

* * * * *